United States Patent [19]

Musgrave

[11] 4,115,943

[45] Sep. 26, 1978

[54] RESERVE MAGAZINE HOLDER

[76] Inventor: Daniel D. Musgrave, 8201 Caraway St., Cabin John, Md. 20731

[21] Appl. No.: 801,641

[22] Filed: May 31, 1977

[51] Int. Cl.[2] ..... F41C 27/00

[52] U.S. Cl. ..... 42/90; 42/71 R

[58] Field of Search ..... 42/90, 1 R, 87, 88, 42/71 R, 1 MH, 72

[56] References Cited

U.S. PATENT DOCUMENTS

| | | | |
|---|---|---|---|
| 931,766 | 8/1909 | Kennedy | 42/71 R |
| 939,707 | 11/1909 | Kennedy | 42/71 R |
| 1,526,847 | 2/1925 | Fritz | 42/71 R |
| 2,324,125 | 7/1943 | Van Horn et al. | 42/72 |
| 3,999,321 | 12/1976 | Musgrave | 42/1 MH |

*Primary Examiner*—Charles T. Jordan

[57] ABSTRACT

A holder for carrying one or more magazines in a convenient position for insertion into a firearm. The holder can be attached to existing firearms, or it can be manufactured as a part of new firearms. It includes quick-release means to permit the user to transfer a magazine to the firing position with one hand, while keeping the other hand on the firing grip of the firearm.

4 Claims, 6 Drawing Figures

RESERVE MAGAZINE HOLDER

Many firearms use detachable cartridge magazines which can quickly be removed when empty, to be replaced by full magazines. The additional magazines are usually carried in a pouch on the person of the user. In situations where the utmost firepower is needed there is necessarily a significant delay while a magazine is removed from the pouch, properly oriented, and inserted into its receptacle on the firearm.

The time required to remove the empty magazine is also significant, but some firearms are so constructed that this can be accomplished without releasing the grip of the firing hand, by pressing a release with a finger. This arrangement permits the other hand to be simultaneously reaching for a full magazine. It is readily apparent that if the full magazine is placed in a convenient position, properly oriented, it will be easily and quickly grasped and inserted, and the delay in resumption of fire will thereby be a minimum.

Furthermore, for safety reasons it is sometimes desirable for the user to carry the firearm actually unloaded, but capable of being loaded in the shortest possible time. This can be accomplished by removing the magazine from the firing position and storing it at a convenient location, properly oriented, for quick insertion into the firing position.

It is also sometimes necessary to have two or more different types of ammunition available for use with a single firearm, with the capability of choosing which type to fire when the target is identified. One method of doing this is to carry each type of ammunition in a separate magazine, with external identification. Obviously, the several magazines should be readily available for insertion into the firing position.

It is desired to point out that the word firearm is used herein in a broad sense, and that it should not be construed as limited to any particular class. The illustrations are exemplary, and have been chosen only for purposes of disclosure. The embodiments shown should not be considered limiting, as the principle of the invention can be applied to various classes of firearms.

Furthermore, this invention can be employed with replicas of firearms, or with dummy training firearms such as are sometimes used in military forces. Expressed differently, it is not intended to limit the utility of this invention to firearms capable of firing live ammunition. It can also be used with dummy, replica, or non-shooting "firearms".

In consideration of the foregoing, the principal object of this invention is to provide a magazine holder which will expedite the exchange of detachable magazines on firearms.

This and other objects of the present invention will be apparent upon reference to the following specification, taken in connection with the accompanying drawings, wherein.

Figure 1:
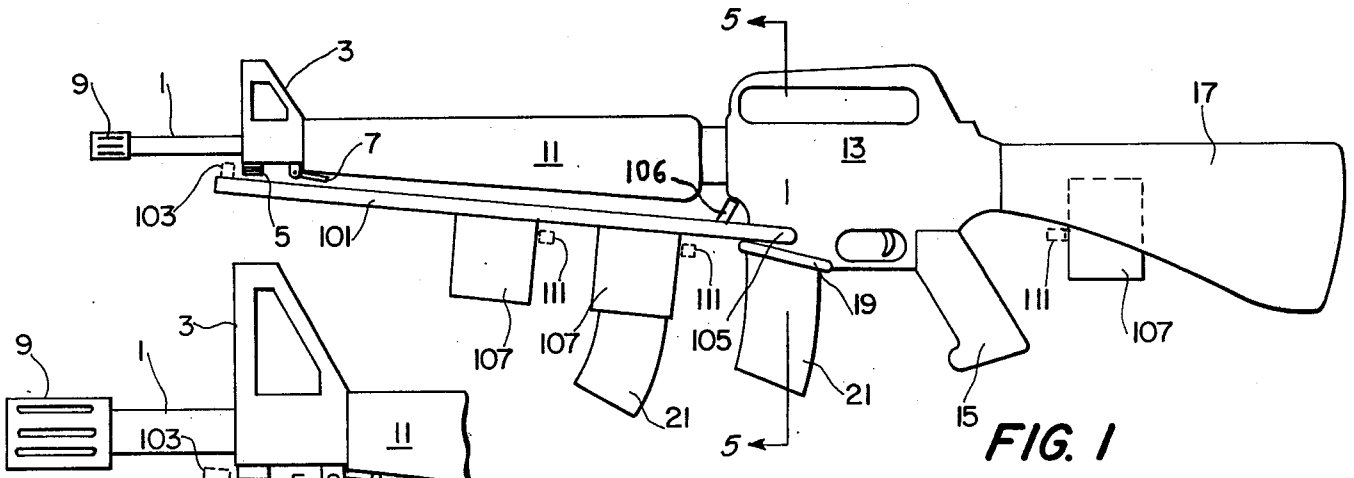
FIG. 1 is a left side view of a typical military firearm, with a magazine holder attached thereto.
Figure 6:
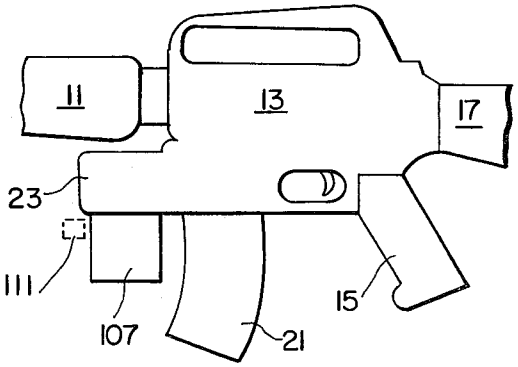

FIG. 6 is a partial left side view of a military firearm, showing a magazine holder incorporated into the firearm during manufacture. Referring to the drawings in detail, FIG. 1 shows a firearm comprising a barrel 1, a sight bracket 3, a bayonet lub 5 affixed to the sight bracket and a sling swivel 7 pivoted on the bracket. On the muzzle of the barrel is the usual type of flash suppressor 9, and a considerable part of the barrel is enclosed in a hand guard 11. The barrel and hand guard are fixed to a receiver 13 in the usual manner. Also fixed to the receiver is a firing grip 15 and a butt stock 17.

The details described thus far are well-known in the art. For convenience of disclosure, FIG. 1 shows a military rifle having generally the configuration of the 5.56 mm United States rifle, M16 series. The invention can also be applied to other firearms, with variations of dimensions and geometry, by making changes in details without departing from the principle disclosed herein.

Figure 5:
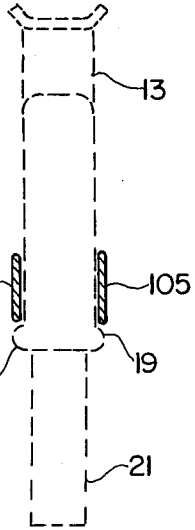
FIG. 5 is a cross section of the firearm shown in FIG. 1, taken in the plane 5—5.

The M16 has a magazine housing near the front of receiver 13. The opening into which the magazine is inserted has a slightly flared edge to facilitate such insertion. This flared edge forms an external rib 19 which may be seen in FIGS. 1 and 5. A magazine 21 can also be seen in FIGS. 1 and 5, it being inserted into the receiver and retained by a latch (not shown) at a feeding position in the usual manner.

Attention has been particularly directed to rib 19 because it, and bayonet lub 5, can be used as means to conveniently attach a frame 101 to the rifle. Of course, with various firearms other attaching arrangements may be necessary.

Figure 2:
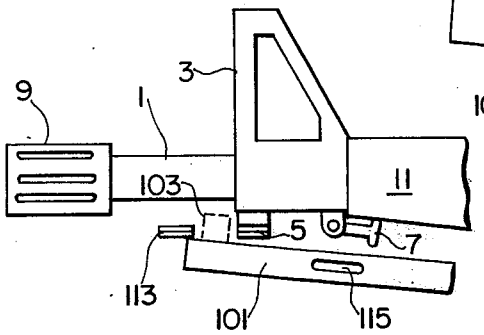
FIG. 2 is an enlarged view of part of FIG. 1.
Figure 3:
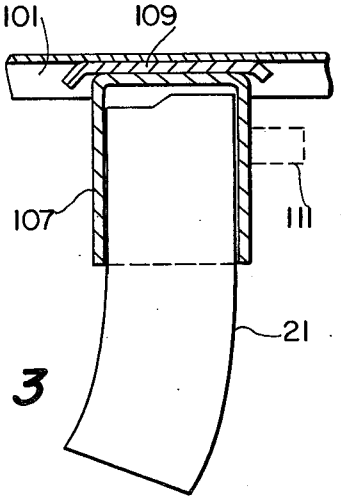
FIG. 3 is a longitudinal section of a portion of the holder shown in FIG. 1.
Figure 4:
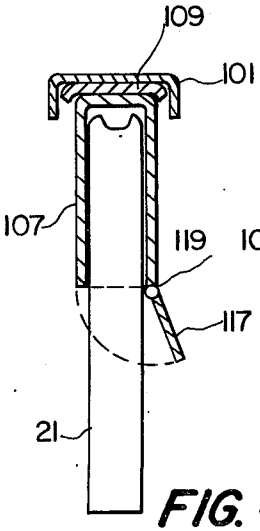
FIG. 4 is a cross section of the holder shown in FIG. 1.

Near its forward end frame 101 is affixed to bayonet lug 5 by a latch which is indicated by box 103 in FIGS. 1 and 2. Latches of the type used on bayonets are well known, and therefore the latch indicated by box 103 need not be described in detail here.

Frame 101 may be made in the form of a channel. To support the rear end of the frame the web of the channel may be cut out leaving a forked end having two members 105 which are visible in FIG. 5. The members are so spaced and dimensioned that they may rest on rib 19 of the magazine housing of the firearm. To keep members 105 in contact with rib 19, a simple strut 106 projects upward from frame 101 and bears against an overhanging portion of receiver 13. This will prevent rattling of the frame against the receiver.

Affixed to frame 101 in any suitable manner is at least one magazine holder 107. The holder may be formed somewhat like a close-fitting hood into which the feed end of a magazine is inserted. A typical latch for retaining a magazine in each holder is indicated by box 111 near each holder. If the holder is fitted very closely to the magazine, friction may be employed to retain the magazine in the holder. If the magazine is made of steel, the holder can be magnetized in order to retain the magazine therein. A heat shield 109 may be interposed between the holder and the frame to prevent excessive heat transfer from the barrel of the firearm to a magazine stored in a holder near the barrel.

The heat shield may be of any suitable material, such as asbestos. The hood-like holder will keep foreign matter out of a magazine stored therein. To keep foreign matter out when no magazine is in the holder it may be provided with a simple hinged cover 117 on a pivot 119, and having some form of latch (not shown) to keep it closed when necessary.

Magazine holders can also be manufactured as part of the firearm itself. In FIG. 1 for example, a holder 107 is shown installed in stock 17. Another example is shown in FIG. 6 where receiver 13 has an extension 23 which accommodates a holder 107.

In FIGS. 1 and 2 installation of frame 101 on the firearm interferes with normal use of bayonet lug 5 and sling swivel 7. In FIG. 2 therefore, a supplementary bayonet lug 113 and a slot 115 which can engage a sling, are provided on frame 101, to permit use of the bayonet or sling in the usual manner.

In operation, the firearm is loaded and fired in the usual manner, but one or more extra loaded magazines are carried in holders as already described. When the magazine in the firearm is empty, it is discarded and a full magazine is transferred from a holder to the magazine housing in the receiver. In the M16 series rifles the firing hand, while holding the grip, can unlatch and drop the empty magazine while the other hand unlatches a stored magazine and transfers it to the firing position. No time is lost in orienting the fresh magazine, and firing is resumed with a minimum of delay.

In FIG. 1 it can be seen that if the shooter is holding grip 15 with his shooting hand, he can support the firearm with his other hand by gripping one of the holders 107 which are affixed to frame 101. By using the holder as a grip the hand is immediately ready to transfer a magazine, when needed.

Although FIG. 1 was described herin before as a typical military firearm, it could just as well be a replica firearm, not capable of shooting.

It is desired to emphasize that the holder and supporting frame are shown in simplified form for purpose of disclosure. In actual practice it would be necessary to adjust details and dimensions to suit various firearms and magazines.

What I claim is:

1. A frame arranged for attachment to a firearm having a stock and a detachable magazine adapted for installation at a feeding position on said firearm said frame including: means for storing said magazine at a non-feeding position separate from said feeding position, quickly releasable detent means capable of retaining said magazine at said non-feeding position and insulating means for shielding a magazine stored at said non-feeding position from heat emanating from a barrel of said firearm.

2. A combination as set forth in claim 1 wherein said frame readily is removable from said firearm.

3. A combination as set forth in claim 1 wherein said frame is adapted for engagement with a military bayonet lug on said firearm.

4. A combination as set forth in claim 3 further characterized by a supplemental military bayonet lug on said frame.

* * * * *